US005947871A

United States Patent [19]

Gilcrease

[11] Patent Number: 5,947,871

[45] Date of Patent: Sep. 7, 1999

[54] HAND GRIP EXERCISER

[75] Inventor: Bryan S. Gilcrease, 5909 NW. 62nd St., Oklahoma City, Okla. 73122

[73] Assignee: Bryan S. Gilcrease, Oklahoma City, Okla.

[21] Appl. No.: 08/977,087

[22] Filed: Nov. 24, 1997

[51] Int. Cl.[6] ..... A63B 23/16; A63B 21/045

[52] U.S. Cl. ..... 482/49; 482/127

[58] Field of Search ..... 482/44, 49; D21/198; 16/114 B; 24/16 R; 294/171

[56] References Cited

U.S. PATENT DOCUMENTS

| | | | |
|---|---|---|---|
| D. 228,004 | 7/1973 | Riccio . | |
| D. 367,817 | 3/1996 | Halpin et al. | D21/198 |
| 1,549,710 | 8/1925 | Campbell . | |
| 2,364,105 | 12/1944 | Socke | 16/114 B |
| 2,793,917 | 5/1957 | Ward . | |
| 2,876,486 | 3/1959 | Lindstrom . | |
| 3,083,366 | 3/1963 | Franges | 16/114 B |
| 3,095,198 | 6/1963 | Gasche . | |
| 3,326,550 | 6/1967 | Melchiona . | |
| 3,541,990 | 11/1970 | Dumas . | |
| 4,240,624 | 12/1980 | Wilson . | |
| 4,252,319 | 2/1981 | Lorang . | |
| 4,754,963 | 7/1988 | Dowd . | |
| 5,222,926 | 6/1993 | Eggen | 482/49 |
| 5,722,117 | 3/1998 | Nielson | 482/49 |

OTHER PUBLICATIONS

Gripmaster Brochure, IMC Products Corporation, Hicksvile, New York.

The Gripp Brochure; Pro–Innovative Concepts, Inc. Phoenix, Arizona.

Pro Eggservizer Brochure; Eggstra Eneterpises, Inc., Alabaster, AL.

Wilson Power Squeez Brochure; Fastrac Communications, Phoenix, AZ.

Dynogripper Brochure; Journey International, Inc., Tucson, AZ.

*Primary Examiner*—Richard J. Apley
*Assistant Examiner*—Victor K. Hwang
*Attorney, Agent, or Firm*—Frank J. Catalano

[57] ABSTRACT

A hand grip exercise device consists of a resiliently flexible base sheet, preferably but not necessarily of stainless steel, having a length at least as wide as the palm of the hand to be exercised and having a cross section which, in its unflexed condition and taken in a plane transverse to the length of the base sheet, approximates the contour of the palm, forefingers and thumb of the hand to be exercised in a handshake position. A resiliently compressible pad is adhered to the convex surface of the base sheet so as to offer a comfortable, nonslipping gripping surface to the hand. The device further includes at least one additional resiliently flexible reinforcing sheet, also preferably but not necessarily of stainless steel, with a length not greater than the length of the base sheet and with a cross-section which, in an unflexed condition and taken in a plane transverse to its length, is concentrically snugly insertable into the base sheet cross-section. Most preferably, a plurality of substantially identical reinforcing sheets having a length not more than half the length of the base sheet is used so that reinforcing sheets can be inserted in concentric arrangement at any desired position along the length of the base sheet to increase the resistance applied over just a part of the hand or reinforcing sheets may be inserted in end-to-end arrangement to increase the resistance applied across the entire hand.

20 Claims, 4 Drawing Sheets

HAND GRIP EXERCISER

BACKGROUND OF THE INVENTION

This invention relates generally to exercise devices and more particularly concerns devices used to strengthen the hand muscles used in gripping and squeezing motions.

There are a wide variety of hand grip exercisers presently in the marketplace. A-frame devices generally consisting of a pair of hand grips extending radially from a torsion spring providing resistance are generally uncomfortable and do not distribute the resistive force over the width of the hand. Squeezable rubber egg shaped devices and neoprene rubber ball devices are more comfortable but afford a limited range of motion. Deformable bladder filled with sand or other particulate have a greater range of motion than the egg and ball devices, but offer limited resistance and no resiliency and are not very durable. Foam rubber devices molded to fit the palm and slotted to locate the fingers and thumb offer limited ranges of motion and limited resistance. Button type devices spacing apart one bar seated in the palm from separate pads under each finger with compressible coil springs in between to offer resistance have a relatively limited range of motion. None of the devices above described are adjustable to vary the resistance applied to the hand or to any portion of the hand.

It is, therefore, an object of this invention to provide a hand grip exerciser which is comfortable to the user. Another object of this invention is to provide a hand grip exerciser which affords a relatively even distribution of resistance over the hand. A further object of this invention is to provide a hand grip exerciser having a greater range of motion than most known devices. It is also an object of this invention to provide a hand grip exerciser capable of offering significant resistive force against the squeezing or gripping motion. It is yet another object of this invention to provide a hand grip exerciser which is resiliently flexible. It is a primary object of this invention to provide a hand grip exerciser which is adjustable to vary the resistance applied to the hand or a part of the hand.

SUMMARY OF THE INVENTION

In accordance with the invention, a hand grip exercise device is provided which consists of a resiliently flexible base sheet, preferably but not necessarily of stainless steel, having a length at least as wide as the palm of the hand to be exercised and having a cross section which, in its unflexed condition and taken in a plane transverse to the length of the base sheet, approximates the contour of the palm, forefingers and thumb of the hand to be exercised in a handshake position. Preferably, the ends of the cross section extend beyond the major axis of the cross-section so that the cross-section is greater than semi-cylindrical. Preferably, a resiliently compressible pad is adhered to the convex surface of the base sheet so as to offer a comfortable, nonslipping gripping surface to the hand. The device further includes at least one additional resiliently flexible reinforcing sheet, also preferably but not necessarily of stainless steel, with a length not greater than the length of the base sheet and with a cross-section which, in an unflexed condition and taken in a plane transverse to its length, is concentrically snugly insertable into the base sheet cross-section. Most preferably, a plurality of substantially identical reinforcing sheets having a length not more than half the length of the base sheet is used. Thus, one reinforcing sheet can be inserted at any desired position along the length of the base sheet to increase the resistance applied over just a part of the hand or reinforcing sheets may be inserted in end-to-end arrangement to increase the resistance applied across the entire hand. Furthermore, multiple reinforcing sheets can be nested within each other as desired to further increase resistance applied to all or a part of the hand.

By way of definition, the handshake cross-section may be described as having a circular major axis portion of large radius and two circular minor axis portions of small radius, one extending through each end of the major axis portion, the large radius being approximately six to seven times the small radius. A substantially similar cross-section can be described as a contour approximating a 30° to 45° ellipse.

BRIEF DESCRIPTION OF THE DRAWINGS

Other objects and advantages of the invention will become apparent upon reading the following detailed description and upon reference to the drawings in which.

While the invention will be described in connection with a preferred embodiment, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION

Figure 1:
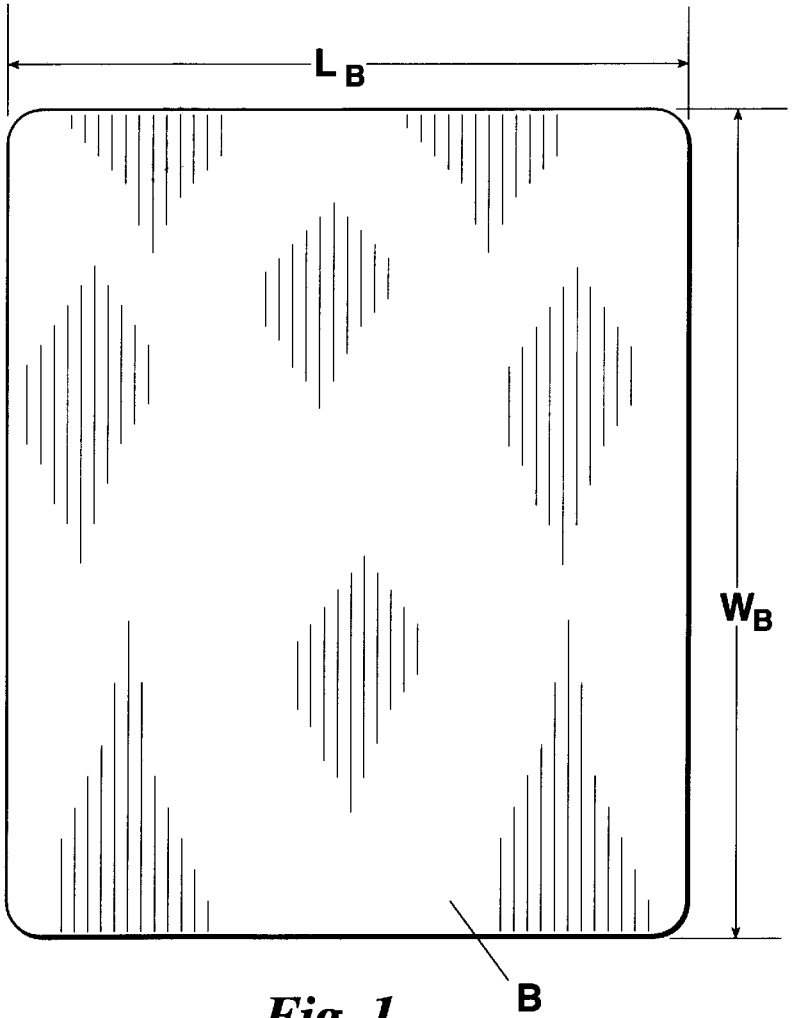
FIG. 1 is a plan view of a base sheet of the exerciser in a flat condition.
Figure 2:
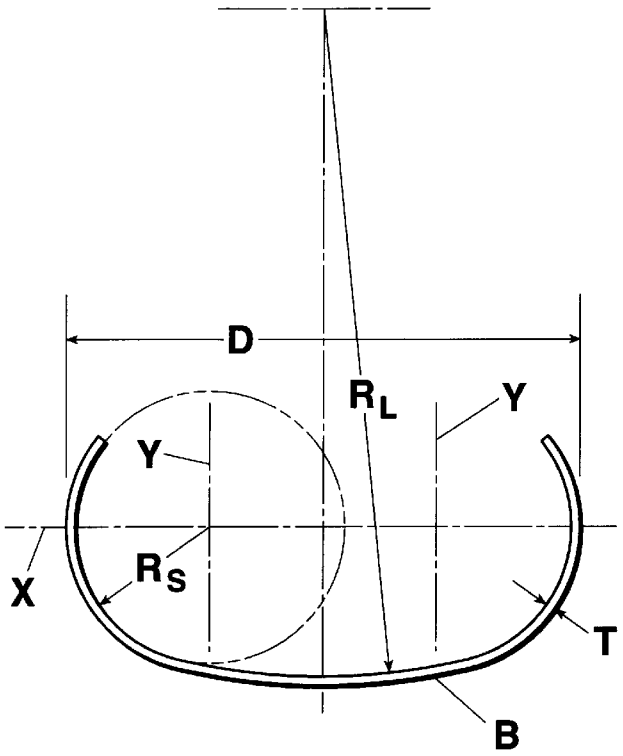
FIG. 2 is an end elevation view of a preferred embodiment of the exerciser in the unflexed condition.

A preferred embodiment of the hand grip exerciser is formed from a base sheet B of resiliently flexible material as shown in FIG. 1 which is bent to a contour in its unflexed condition which approximates the contour of the palm, forefingers and thumb of the hand to be exercised in the handshake position, as is shown in FIG. 2. Whatever the size of the hands being exercised, it is desirable that the base sheet B have a length $L_B$ which is at least as wide as the palm of the hand to be exercised. Typically, for use by an adult with average sized hands, a base sheet B of material will have a length $L_B$ of approximately four inches. Also, as shown in FIG. 2, it has been found quite satisfactory that the cross-section of the base sheet B in the unflexed condition have a portion in the direction of its major axis X defined as the arc of a circle having a large radius $R_L$ and portions extending from the ends of the major axis portion in the direction of its minor axes Y defined as an arc of a circle having a smaller radius $R_S$. The radii $R_L$ and $R_S$ are given to the concave surface of the base sheet B and, for a base sheet B of four inches length $L_B$, the larger radius $R_L$ will be approximately 5½ inches and the smaller radius $R_S$ approximately 13/16 inch. Preferably, the base sheet B is formed of stainless steel having a thickness T of 1/16 inch and in the unbent condition illustrated in FIG. 1, the width $W_B$ of the base sheet D is approximately 4¾ inches which, when bent as shown in FIG. 2, provides a distance D taken across the cross-section along the major axis X of 2⅞ inches. These dimensions are given as typical of a device for use with an adult hand of average size and the radii may be proportioned according to the size of the hand to be exercised.

Figure 3:
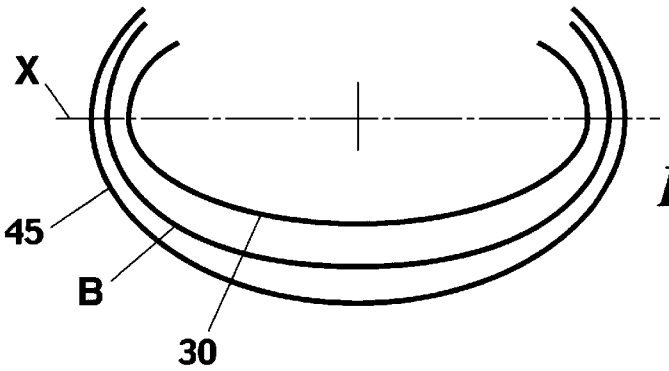
FIG. 3 is a graphic representation of a range of acceptable cross-sections of the exerciser.

The above contour of compound radii has been detailed because a hand grip formed according to these dimensions or proportional to these dimensions depending on the size of the hand to be exercised is known to work effectively. However, as shown in FIG. 3, a reasonable approximation of the contour of FIG. 2 within the context of this disclosure is achieved by the use of an elliptical cross-section in the range of approximately a 30° ellipse 30 to a 45° ellipse 45. It is important, however, to the proper operation of the exerciser that the ends of the cross-section extend beyond the major axis X of the exerciser but not so much as to significantly impair the range of motion achievable in flexing the exerciser.

Figure 4:
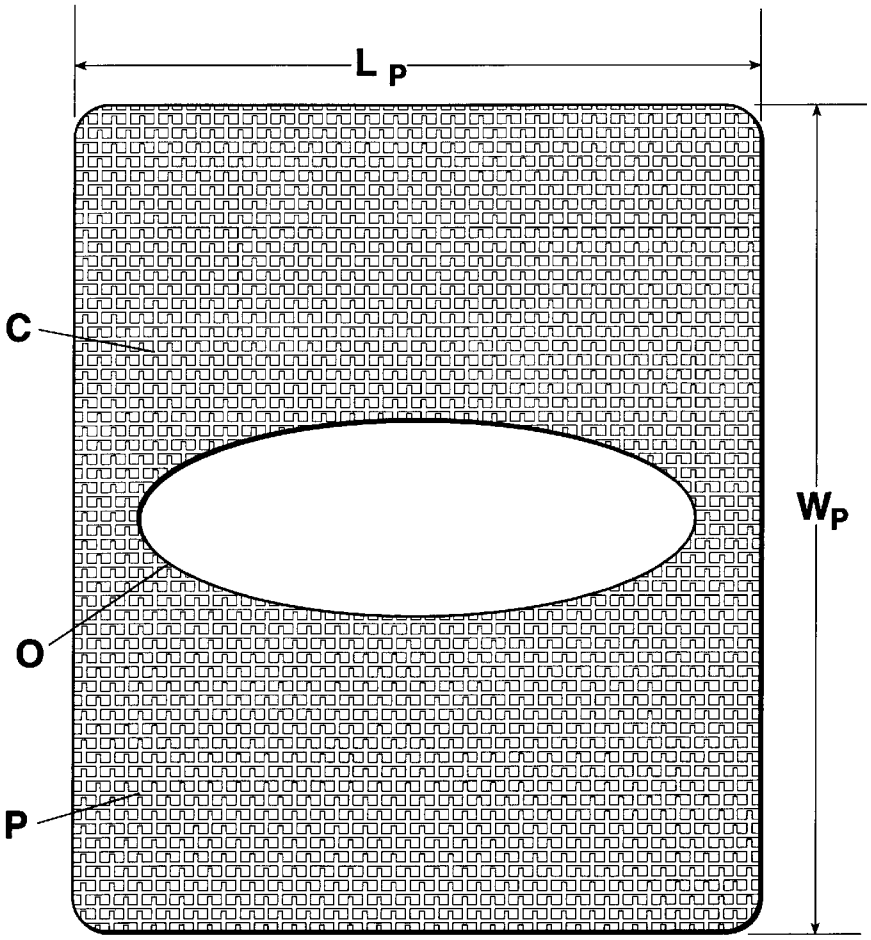
FIG. 4 is a top plan view of a pad for use with the exerciser.

FIG. 4 illustrates an elastically compressible pad P, preferably of the same length and width $L_P$ and $W_P$ as the base sheet B. Preferably, the pad P is made of rubber and has a portion removed to define an opening O. The pad P is adhered to the convex surface of the base sheet B and a portion of the base sheet B will be visible through the opening O in the pad P. This facilitates the application of a silk screen or other design applied to the base sheet B for display through the pad P. Most preferably, the surface of the pad P that is not adhered to the base B will be cross-corrugated C so as to provide maximum comfort and stability of the hand position on the exerciser.

Figure 5:
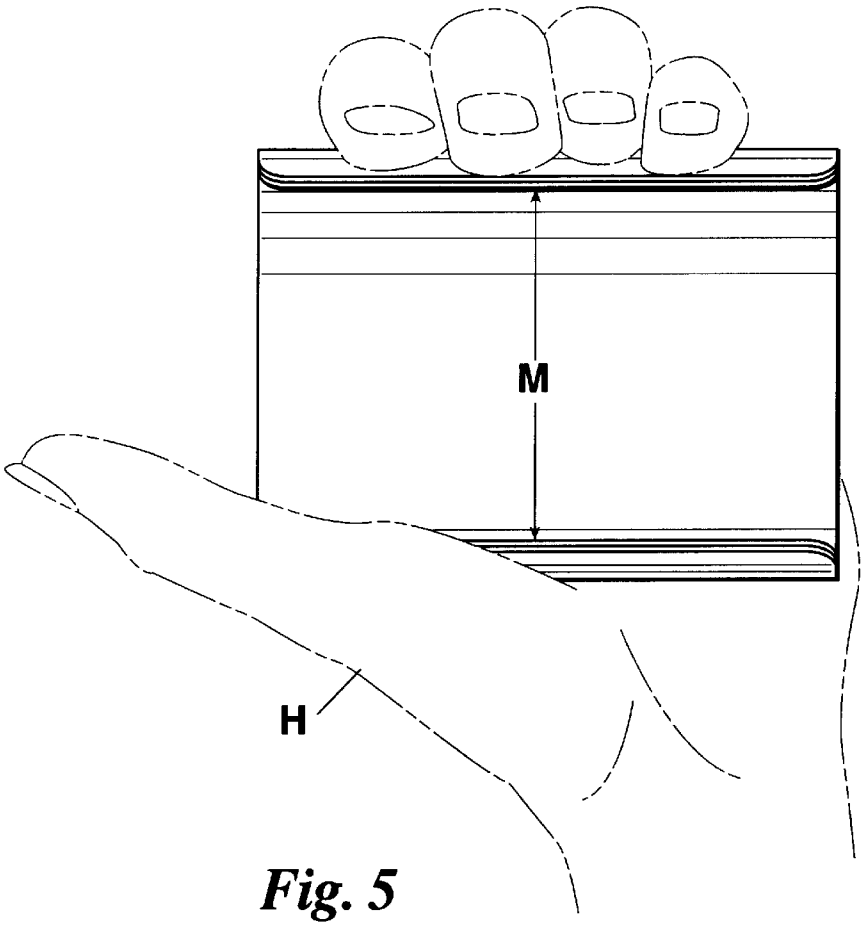
FIG. 5 is a top plan view of the exerciser in the unflexed condition in the hand of a user.

Turning to FIG. 5, the exerciser is shown in its unflexed condition in the handshake grip of the hand H. As shown, given the approximate dimensions hereinbefore described, the exerciser has a range of motion M of approximately two inches. This is approximately two times or more the range of motion provided by the earlier described presently known exercisers.

Figure 6:
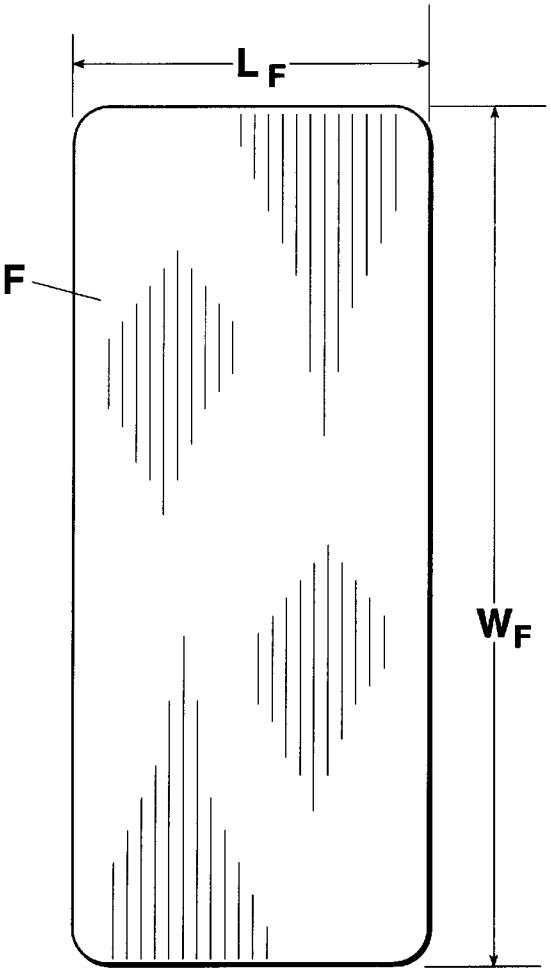
FIG. 6 is a top plan view of a typical reinforcing sheet for use with the exerciser.

Looking at FIG. 6, one or more resiliently flexible reinforcing sheets F having a length $L_F$ which is not greater than the length $L_B$ of the base sheet B are bent to a cross-section which, in an unflexed condition and taken in a plane transverse to the length $L_F$ of the reinforcing sheet F, is concentrically snugly insertable into the cross-section of the base sheet B. Preferably, the reinforcing sheet F is also formed of 1/16 inch stainless steel and has a width $W_F$ which is ⅛ inch less than the width $W_B$ of the base sheet B in order to achieve maximum concentricity. However, a reinforcing sheet F having a width $W_F$ equal to the width $W_B$ of the base sheets would also work effectively. Most preferably, the length $L_F$ of the reinforcing sheets F will be not more than ½ the length $L_B$ of the base sheet B.

Figure 7:
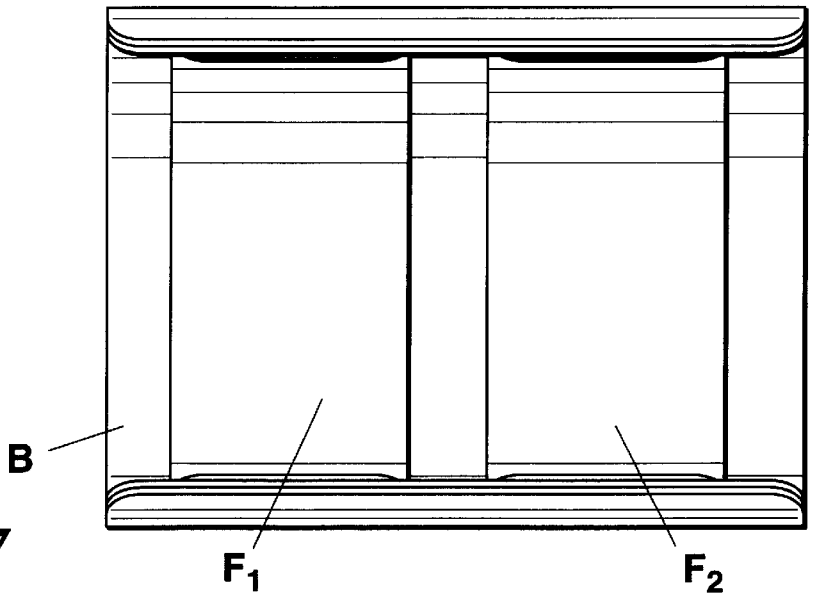
FIG. 7 is a top plan view of the exerciser with reinforcing sheets inserted in end-to-end relationship in the exerciser.
Figure 8:
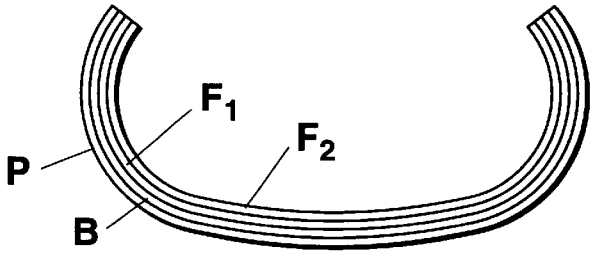
FIG. 8 is an end elevation view of reinforcing sheets concentrically inserted within each other and in the base member of the exerciser.

Looking at FIGS. 7 and 8, the reason for maintaining the length $L_F$ of the reinforcing sheets F to a maximum of ½ the length $L_B$ of the base sheet B can be understood. As seen in FIG. 7, the reinforcing sheets $F_1$ and $F_2$ can be inserted end-to-end into the base sheet B or shifted closer to one end of the base sheet B than the other so as to increase the overall resistance applied to the hand or to locally increase the resistance applied to the portion of the hand H contacting the reinforced portion of the base sheet B. Alternatively, as seen in FIG. 8, the reinforcing sheets $F_1$ and $F_2$ can be concentrically inserted, one in the other and both in the base sheet B, so as to further increase the resistance applied to the portion of the hand H at a particular position along the length $L_B$ of the base sheet B.

Figure 9:
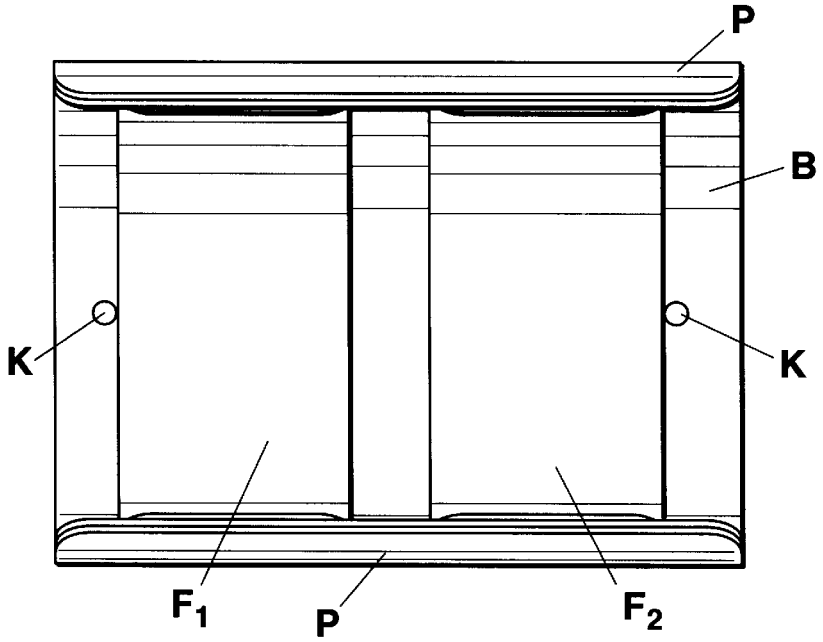
FIG. 9 is a top plan view illustrating a modification of the exerciser.

Turning to FIG. 9, it may be desirable to provide a knob or knurl K on each end of the base sheet B to prevent the reinforcing members $F_1$ and/or $F_2$ from inadvertently sliding out of the ends of the base member B during use.

Figure 10:
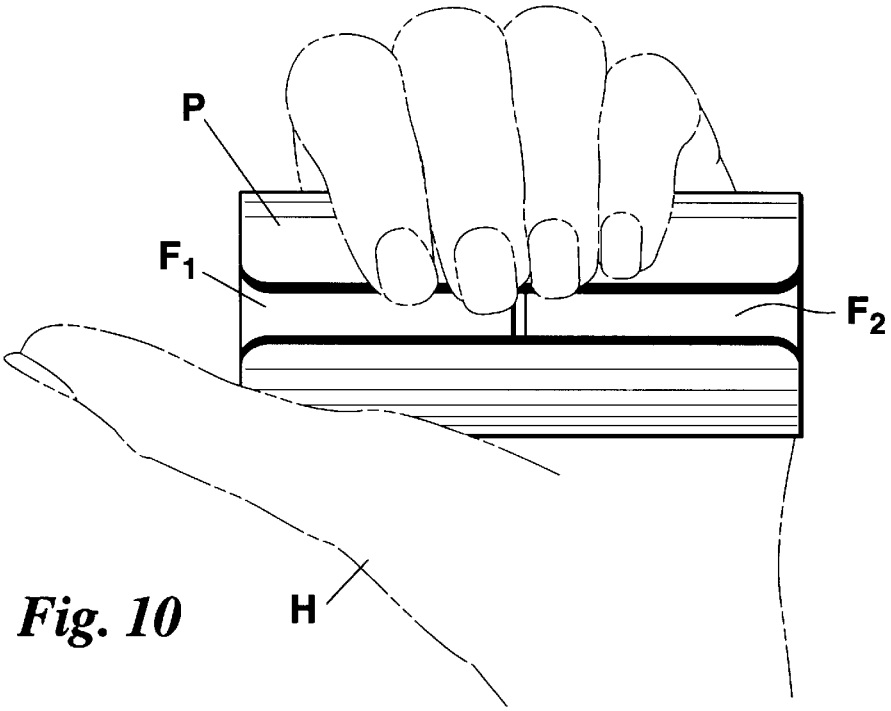
FIG. 10 is a top plan view illustrating an exerciser with reinforcing sheets inserted therein squeezed by the hand to a maximum flex condition.

Finally, looking at FIGS. 5 and 10, the operation of the exerciser can be understood. The exerciser can be used without any reinforcing sheets F being inserted or with any number of reinforcing sheets F being inserted end-to-end and/or concentrically within the base sheet B in order to provide the desired resistance to be applied to the hand in general and to specific portions of the hand in particular. Having so positioned the reinforcing sheets F, the user grasps the exerciser in the unflexed condition illustrated in FIG. 5 and squeezes the exerciser in an effort to bring the longitudinal edges of the device into close proximity at the maximum flex condition of the exerciser. Thus, the user is enabled to exercise individual hand grip muscles against selected applied forces over a great range of motion. The grip is then released to return the exerciser to the unflexed condition of FIG. 5 and the exercise repeated as often as desired.

Thus, it is apparent that there has been provided, in accordance with the invention, a hand grip exerciser that fully satisfies the objects, aims and advantages set forth above. While the invention has been described in conjunction with specific embodiments thereof, it is evident that many alternatives, modifications and variations will be apparent to those skilled in the art and in light of the foregoing description. Accordingly, it is intended to embrace all such alternatives, modifications and variations as fall within the spirit of the appended claims.

What is claimed is:

1. A device for exercising the grip of a person's hand comprising a resiliently flexible base sheet having a length at least as wide as a palm of the hand and having a cross-section in an unflexed condition taken in a plane transverse to said length which approximates a contour of the palm, four fingers and thumb of the hand in a handshake position, said cross-section having ends which extend beyond a major axis of said cross-section and a resiliently flexible reinforcing sheet having a length not greater than said length of said base sheet and having a cross-section in an unflexed condition taken in a plane transverse to said reinforcing sheet length which is concentrically snugly insertable into said base sheet cross-section.

2. A device according to claim 1 further comprising a resiliently compressible pad adhered to a convex surface of said base sheet.

3. A device according to claim 1 further comprising a pair of resiliently flexible reinforcing sheets having a combined length not greater than said length of said base sheet and having cross-sections in an unflexed condition taken in planes transverse to their length which are concentrically snugly insertable into said base sheet cross-section.

4. A device according to claim 1, said handshake cross-section having a circular major axis portion of a first radius and having two circular minor axis portions, one extending from each end of said major axis portion, of a second radius, said first radius being approximately 6 to 7 times said second radius.

5. A device according to claim 1, said handshake cross-section having a contour approximating a 30 to 45 degree ellipse.

6. A device for exercising the grip of a person's hand comprising a resiliently flexible base sheet having a length at least as wide as a palm of the hand and having a cross-section in an unflexed condition taken in a plane transverse to said length which approximates a contour of the palm, four fingers and thumb of the hand in a handshake position, said cross-section having ends which extend beyond a major axis of said cross-section, a resiliently flexible reinforcing sheet having a length not greater than said length of said base sheet and having a cross-section in an unflexed condition taken in a plane transverse to said reinforcing sheet length which is concentrically snugly insertable into said base sheet cross-section and a resiliently compressible pad adhered to a convex surface of said base sheet.

7. A device according to claim 6, said base sheet having means disposed on a concave surface thereof proximate each lengthwise end thereof for preventing said reinforcing sheet from sliding out of said base sheet.

8. A device according to claim 6 further comprising another resiliently flexible reinforcing sheet having a length not greater than said length of said reinforcing sheet and having a cross-section in an unflexed condition taken in a plane transverse to said another sheet which is concentrically snugly insertable into said reinforcing sheet cross-section.

9. A device for exercising the grip of a person's hand comprising:

a resiliently flexible base sheet having a length at least as wide as a palm of the hand and having a cross-section in an unflexed condition taken in a plane transverse to said length approximating a contour of the palm, four fingers and thumb of the hand in a handshake position, said cross-section having ends which extend beyond a major axis of said cross-section;

a resiliently compressible pad;

means for adhering said pad to a convex surface of said base sheet;

a plurality of substantially identical resiliently flexible reinforcing sheets, each having a length not greater than half said length of said base sheet and having a cross-section in an unflexed condition taken in a plane transverse to its length such that each of said plurality of reinforcing sheets is substantially concentrically snugly insertable into said base sheet and into others of said reinforcing sheets.

10. A device according to claim 9, said base sheet having means disposed on a concave surface thereof proximate each lengthwise end thereof for preventing said reinforcing sheets from sliding out of said base sheet.

11. A device according to claim 9, said handshake cross-section having a circular major axis portion of a first radius and having two circular minor axis portions, one extending from each end of said major axis portion, of a second radius, said first radius being approximately 6 to 7 times said second radius.

12. A device according to claim 9, said handshake cross-section having a contour approximating a 30 to 45 degree ellipse.

13. A device according to claim 9, said base sheet being formed of stainless steel.

14. A device according to claim 13, said reinforcing sheets being formed of stainless steel.

15. A device according to claim 14, said base sheet and reinforcing sheets being approximately 1/16" thick.

16. A device according to claim 15, said length of said base sheet being approximately 4" and a perimeter of said cross-section of said base sheet being approximately 4¾".

17. A device according to claim 16, said length of said reinforcing sheets being not more than 2" and a perimeter of said cross-section of said reinforcing sheets being approximately 4⅝".

18. A device according to claim 9, said pad being formed of rubber.

19. A device according to claim 18, a surface of said pad not adhered to said base sheet being cross-corrugated.

20. A device according to claim 18, a portion of said pad being removed to expose a portion of said convex surface of said base sheet.

* * * * *